US005745095A

United States Patent [19]

Parchem et al.

[11] Patent Number: 5,745,095

[45] Date of Patent: Apr. 28, 1998

[54] COMPOSITING DIGITAL INFORMATION ON A DISPLAY SCREEN BASED ON SCREEN DESCRIPTOR

[75] Inventors: John M. Parchem, Seattle; Robert M. Fries, Redmond, both of Wash.

[73] Assignee: Microsoft Corporation, Redmond, Wash.

[21] Appl. No.: 572,292

[22] Filed: Dec. 13, 1995

[51] Int. Cl.[6] ..... G09G 5/00

[52] U.S. Cl. ..... 345/114; 345/509

[58] Field of Search ..... 345/189, 190, 345/201, 203, 196, 185, 115, 113, 114, 119, 120; 348/564, 563, 567; 395/508, 509, 512

[56] References Cited

U.S. PATENT DOCUMENTS

| | | | |
|---|---|---|---|
| 4,688,167 | 8/1987 | Agarwal | 345/113 |
| 5,175,624 | 12/1992 | Hieda et al. | 348/563 |
| 5,644,758 | 7/1997 | Patrick et al. | 345/189 |

*Primary Examiner*—Chanh Nguyen
*Attorney, Agent, or Firm*—Ronald M. Anderson

[57] ABSTRACT

A method and system for producing a composite image of two or more graphic objects. In a set top box (44) designed to be used with a television receiver or video monitor (40), an application specific integrated circuit (ASIC) (76) is provided that includes a dynamic composition engine (DCE) (84), which generates a composite image for display on the screen of the television receiver. The composite image is based upon Screen Descriptor data that include a Line Descriptor defining each scan line using Span Descriptors. A Span Descriptor defines the portion of a line occupied by one of the objects that will comprise the composite image and specifies how that object will be combined with other objects on the line. A line buffer is filled with the pixels for the scan line next to be displayed while data in a second line buffer are written to the display screen. The two line buffers are then switched, enabling the next line to be composed in one line buffer while the data in the other line buffer are written to the screen. A new Screen Descriptor is produced if a change in the composite image occurs. When the last Line Descriptor in the current Screen Descriptor is processed, a pointer to the new Screen Descriptor is passed to the DCE to enable the new Screen Descriptor to be used for generating the next frame on the display screen.

30 Claims, 4 Drawing Sheets

COMPOSITING DIGITAL INFORMATION ON A DISPLAY SCREEN BASED ON SCREEN DESCRIPTOR

FIELD OF THE INVENTION

This invention generally relates to a method and a system for displaying objects on a display screen; and more specifically, to handling both digital and analog data that are to be composited and simultaneously displayed on a scan line of the screen.

BACKGROUND OF THE INVENTION

The relatively wide bandwidth for distributing signals on a cable television network can be used for purposes other than simply distributing broadcast television signals. One of the ideas currently being developed and tested will permit subscribers to interact with a television program that is being viewed. For example, using a remote control as an input device, the subscriber will be able to enter a vote on some issue. This system would also enable viewers of a show to determine how the plot of the show develops. Another use of such a system will be to enable a user to select pay-for-view movies, on demand, for viewing when the subscriber chooses, rather than in accord with a fixed timetable.

An interactive television interface will be required for input of a selection by the user, since a conventional television does not have the capability to produce a signal for transmission over the cable network. Because of its likely position atop a television receiver, such an interface has been referred to as a "set top box."

With the advent of such interactive television, it is likely that software application programs will be developed to implement an on-screen interface for prompting interactive input by the viewer. Other types of software applications, including visually complex video games might also be run on a set top box. It is likely that the viewer will be given more control over the nature of the image displayed on the screen, including the ability to modify the image or to combine the broadcast image with other signals such as those generated by a computer or another video source in a particular manner. However, conventional television receivers do not have the capability to combine a broadcast signal from a television network (or the signal from a laser disc player or video recorder) with a digital graphics signal from a computer to produce a composite image that can be displayed on the television screen. Providing a picture-in-a-picture is the closest that conventional television sets come to this capability. To combine such signals, a set top box will be required that provides a composite display of video and digital graphic signals in various formats for input to the television receiver (or video monitor).

Although the ability to produce a composite signal that combines two objects or elements on a screen is relatively straightforward using a variety of known techniques, a technique for producing a composite image combining more than two objects, particularly using a technique that requires only a relatively small video memory, is not disclosed in the prior art. An economically feasible set top box with such capabilities will thus require a novel approach for handling diverse types of video and digital graphic signals efficiently, using hardware that is relatively low in cost.

SUMMARY OF THE INVENTION

In accordance with the present invention, a method is defined for displaying objects on a screen as an image that comprises a plurality of scan lines. The method includes the step of storing bitmap data in a memory for each object to be displayed on the screen. A data structure based on the bitmap data for each object is created and stored in the memory. The data structure describes each object to be displayed on the screen and includes a Screen Descriptor referencing a plurality of Line Descriptors that define the composition of each scan line of the screen and provide a composite for any overlapping objects on the scan line. The data structure is stored in the memory and is processed to produce video data for each scan line to be displayed on the screen. An image is then produced on the screen using the video data for the scan lines.

The plurality of Line Descriptors each include at least one Span Descriptor. Each Span Descriptor comprises information required to compose a span of the scan line, and each span comprises a segment of the scan line in which one of a background and at least a portion of an object is disposed. In a scan line, spans may be overlapping, blended, and multiple pixel formats.

The information in the Span Descriptor includes a length and a position of a span in the scan line. An opcode in the Span Descriptor describes a format for elements of the screen comprising the image to be displayed. In addition, the information in the Span Descriptor includes a value that determines how the span will be mixed with an element that it overlaps in the scan line when the scan line is displayed on the screen. In one embodiment, the data structure is processed one scan line at a time to generate the image. In another embodiment, the data structure is processed for a plurality of scan lines at a time to generate the image.

The Screen Descriptor preferably includes pointers to the Line Descriptors that are stored in the memory. The Screen Descriptor also includes a plurality of entries corresponding in number to the number of scan lines on the screen. An entry for a scan line comprises a count indicating the number of spans on the scan line and a pointer to the Line Descriptor for the scan line.

The step of processing the data structure to produce video data for each scan line comprises the step of alternately loading one of two scan line composition buffers with the video data while video data in the other scan line composition buffer are displayed on the screen. The other scan line composition buffer is then loaded with video data while the video data in the one scan line composition buffer are displayed on the screen.

Preferably, the method also includes the step of creating an inactive Screen Descriptor that becomes active when a new frame is to be displayed on the screen. The Screen Descriptor that was previously used to produce video data then becomes inactive while being updated to display a subsequent new frame on the screen. Screen Descriptor entries are either copied from an active Screen Descriptor to the inactive Screen Descriptor for any scan lines that are unchanged in the subsequent new frame to be displayed, or a pointer is provided to a Screen Descriptor entry in the active Screen Descriptor that will be used in the inactive Screen Descriptor; new entries are created for scan lines that are changed in the subsequent new frame. A last Scan Descriptor in the active Screen Descriptor activates the inactive Screen Descriptor and inactivates the active Screen Descriptor.

Furthermore, in the preferred embodiment, one Span Descriptor in a Line Descriptor can specify a fixed palette, and a different Span Descriptor in the Line Descriptor may specify a variable palette, to determine colors that are applied to each object displayed in the line on the screen. The fixed palette is a universal palette that includes colors selected to optimally display objects on the screen. The variable palette is a palette associated with an object, and may be different for different objects.

Another aspect of the present invention is directed to a system adapted for controlling the display of objects on a screen as an image comprising a plurality of scan lines. The system includes a memory for storing bitmap data for each of the objects and machine instructions controlling the operation of the system. A processor, coupled to the memory, is provided for executing the machine instructions so as to implement a plurality of functions used for controlling the display of the objects. The plurality of functions include producing control signals for a dynamic composition engine (DCE). The DCE produces video signals that are adapted to drive the screen to display the objects in response to the control signals and includes means for creating a data structure based upon the bitmap data for each of the objects to be displayed. The data structure, which is stored in the memory, describes each object to be displayed on the screen and includes a Screen Descriptor referencing a plurality of Line Descriptors that define the composition of each scan line of the screen. Means are also provided in the DCE for processing the data structure to produce video data for each scan line to be displayed on the screen. Further, means are included in the system for generating an image on the screen using the video data for the scan lines of the screen.

Other functions implemented by the system are generally consistent with the description of the method provided above.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
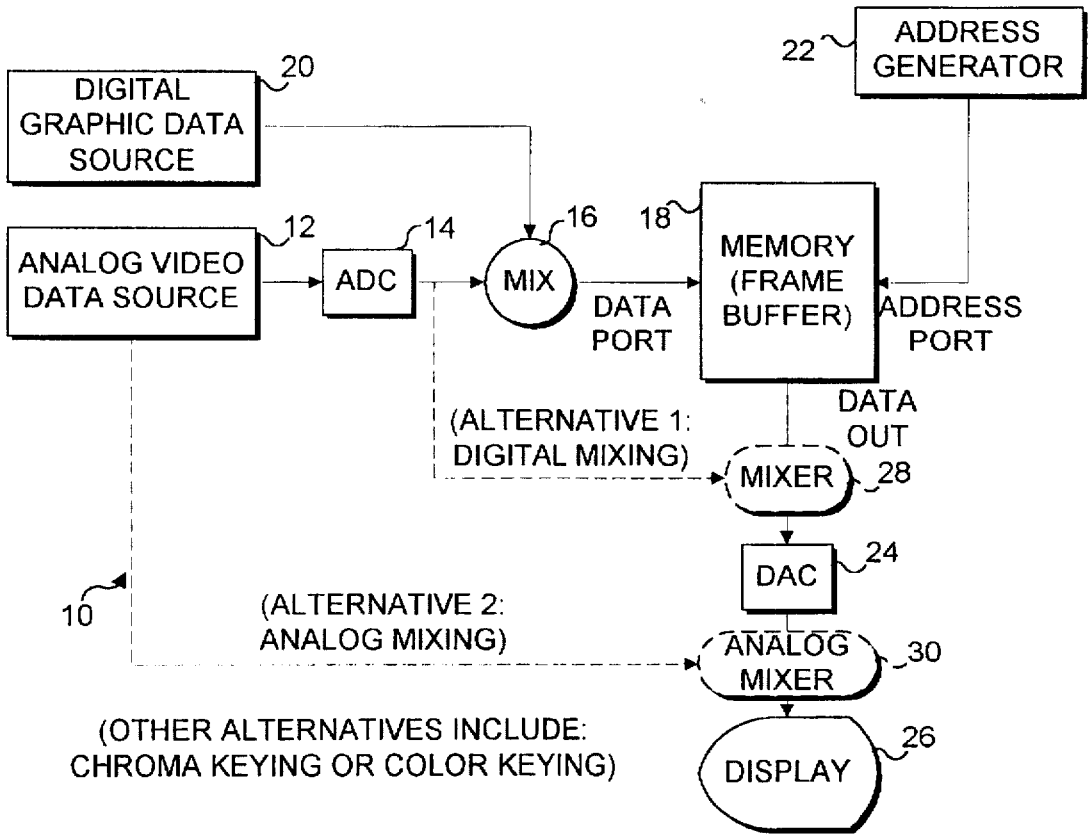
FIG. 1 (PRIOR ART)
FIG. 1 is a block diagram showing several alternative prior art techniques for combining two objects to produce a composite image on a display screen.

As discussed above in the Background of the Invention, the present invention addresses the problem of producing a composite image in which a plurality of different graphic objects are combined and displayed. Details of the prior art solution for solving this problem are shown in a block diagram 10, in FIG. 1. In this Figure, an analog video data source 12, which may correspond to an antenna for receiving broadcast signals, a cable connection, or a video cassette recorder (VCR) or other device produces an analog signal that conveys an image to be composited with objects in a signal produced by a digital graphic data source 20. Digital graphic data source 20 may, for example, comprise a processor that is used for producing a bitmapped dialog box or other graphic object for display with an analog video data image produced by analog video data source 12.

The most common approach in the prior art for producing such a composite image is to store a mix of the two images to be combined in memory. Initially, the analog video data source signal is digitized using an analog-to-digital converter (ADC) 14. The corresponding digital signal produced by ADC 14 is input to a mixer 16, to be combined with the digital signal produced by digital graphic data source 20. Mixer 16 adds the two digital signals in a predefined manner, producing a mixed digital data output signal that is input to a memory (frame buffer) 18. Memory 18 stores one frame or screen of data defining the composite image that will be displayed to a user. An address generator 22 supplies the appropriate address to determine the location in memory for storing the image data that will be used for displaying each pixel of the composite image. In addition, the address generator supplies the address for subsequently reading the digital data stored in memory to produce an output signal that is applied to a digital-to-analog converter (DAC) 24. DAC 24 converts the digital data output from the memory to a corresponding analog signal appropriate to drive a display 26. Typically, display 26 comprises a cathode ray tube or other video display device commonly used in the art for a television receiver or video monitor.

An alternative prior art approach for producing a composite image eliminates mixer 16, since only the digital data corresponding to the image produced by digital graphic data source 20 are stored in memory 18. The digital signal output from ADC 14, instead of being mixed with the other Screen of digital data from the digital data source for storage in memory 18, is input to a mixer 28, which is coupled to the output port of memory 18. Mixer 28 thus mixes the digital data retrieved from memory 18 with the digital data output from ADC 14 to produce a mixed digital signal. The output signal from mixer 28 comprises a composite digital signal that is input to DAC 24, which generates a corresponding analog signal. The analog signal produced by the DAC is then input to display 26 to produce a composite image.

A third prior art alternative also uses memory 18 to store just the digital data from the graphic digital data source. To produce the composite image, the stored digital data is retrieved from memory and input to DAC 24. The analog signal produced by analog video data source 12 is then mixed with the analog signal output from DAC 24, using an analog mixer 30. In this third alternative, the analog video data are not converted to corresponding digital data. The output from analog mixer 30 thus comprises an analog signal that is usable to produce the composite image of the images produced by digital graphic data source 20 and analog video data source 12.

Yet another alternative in the prior art uses chroma keying to mix image data. This technique employs a blue screen as a background in one image and superimposes the foreground object(s) in this image on an image from a different source to provide a composite image.

Figure 2:
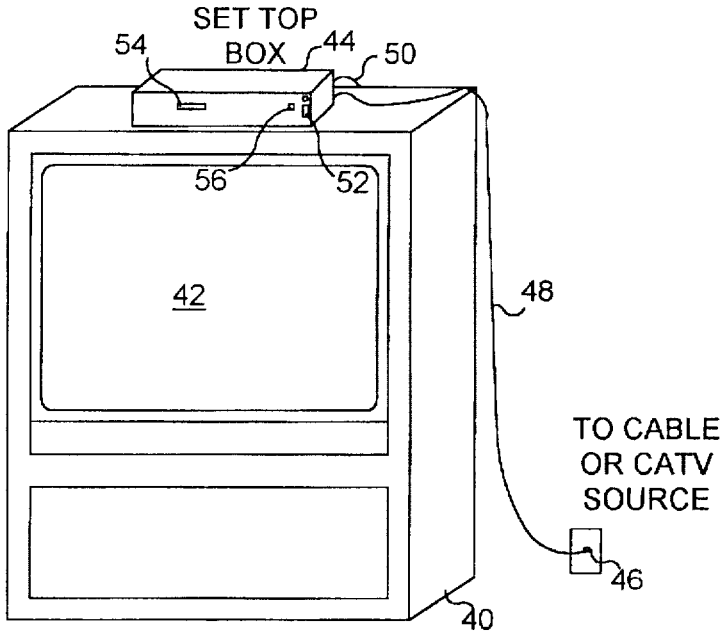
FIG. 2 is an isometric view of a conventional television receiver or video monitor and a set top box that enables different types of video signals including a plurality of objects to be combined in a composite image on the screen of the television receiver or monitor.

Each of the prior art techniques for mixing images to produce a composite image is limited in the number of image signals that can be combined. Typically, these prior art techniques are only used for combining signals from two sources and are not readily applied to mixing objects from more than two different images to produce a composite image. In addition, each of the prior art techniques typically requires that at least one frame of image data be stored in memory to produce a composite image on display 26. The lack of efficiency in handling many diverse objects to produce a composite image in these prior art techniques has led to the development of the present invention, which is embodied in a set top box 44, shown in FIG. 2. Set top box 44 is intended to be used with a television receiver or video monitor 40 having a conventional display screen 42. It is contemplated that the set top box might be used to combine signals from several video sources besides a broadcast station, such as a laser disc player or VCR (not shown in FIG. 2). The set top box will most likely be coupled to receive a signal from either a rooftop antenna, satellite receiver, a cable system, or community antenna television (CATV) system, as shown in FIG. 2. Signals can be transmitted from the set top box over the cable system to a suitable receiver at a cable/network facility (not shown).

In FIG. 2, a line 48 connects a bidirectional (input/output) terminal (not shown) on the rear panel of set top box 44 to a corresponding cable outlet 46. A line 50 connects audio and video output terminals (not shown) on the back of the set top box to corresponding audio and video input terminals (not shown) on the back of television receiver 40. The images produced by set top box 44 or passed through the set top box from the connection to an external source are displayed by television receiver 40 on display screen 42 and may comprise the images conveyed by a broadcast television signal, a video game image, and in the case of the present invention, a composite image produced by combining signals from two or more analog/digital image data sources. Digital graphic objects may be generated, for example, by circuitry within set top box 44. These graphic objects may include on-screen menus or dialog boxes generated in response to machine instructions comprising software applications executed by set top box 44. The software (machine instructions) for such applications can be loaded by inserting a read only memory (ROM) card in a program card slot 54, or downloaded via line 48, from a station connected to the cable system. The set top box includes a power switch 52 and other controls. An infrared sensor 56 on the front panel of the set top box enables it to receive input signals and commands from a user that are transmitted from an infrared source contained in an external remote control (not shown).

Figure 3:
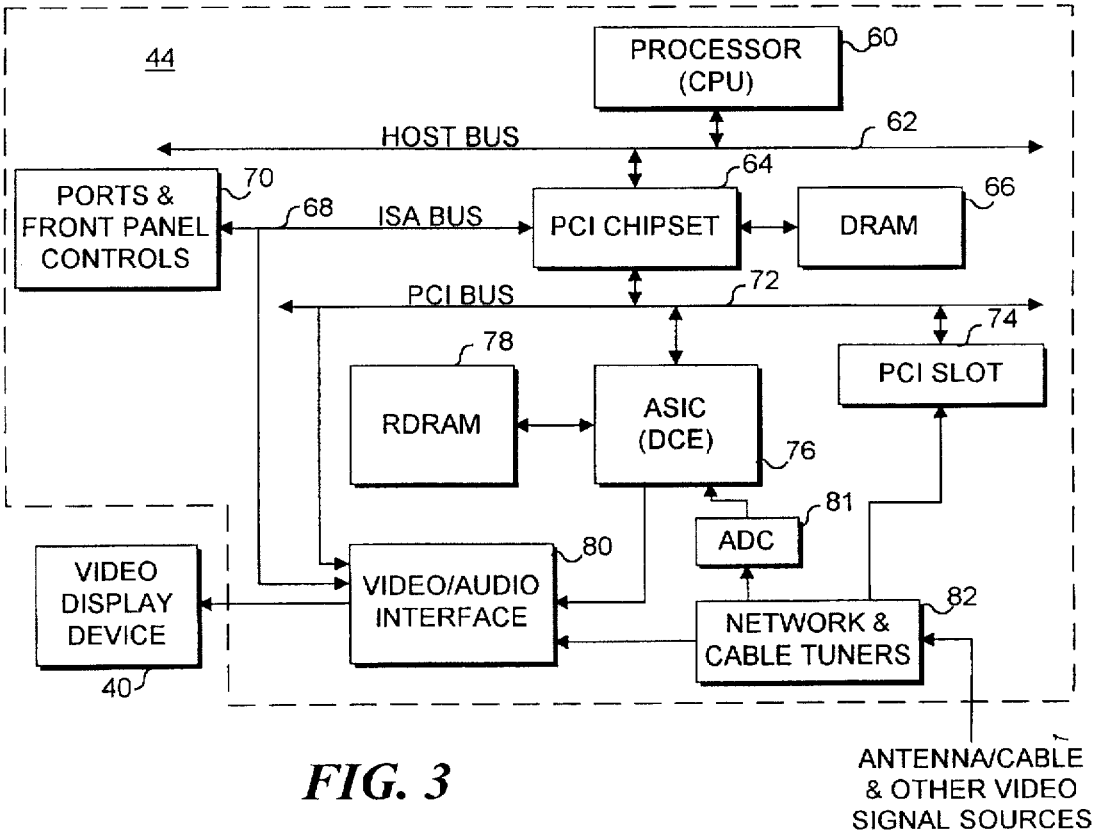
FIG. 3 is a block diagram of the set top box, showing its functional components, for use in displaying an image on a video display device (e.g., television receiver or monitor)

Further details of the internal circuitry within set top box 44 are shown in FIG. 3. The set top box is controlled by a central processing unit (CPU) 60. An operating system comprising machine instructions controls CPU 60 when the set top box is initially energized or reset. The CPU can then load and execute machine instructions comprising application software programs.

CPU 60 is coupled to a host bus 62, which is connected to other components in the device, including a peripheral component interface (PCI) chip set 64. The PCI chip set provides for fast data transfer between the host bus and a PCI bus 72 to improve the efficiency with which data are moved between CPU 60 and other components of the set top box. In addition, PCI chip set 64 is coupled to a conventional ISA bus 68 through which are connected input/output ports and controls, as indicated in a block 70. Dynamic random access memory (DRAM) 66 is also connected to the PCI bus, providing volatile storage for data and for machine instructions used to CPU 60.

PCI bus 72 is coupled to a PCI slot 74 and to an application specific integrated circuit (ASIC) 76. ASIC 76 is connected to 16 MBytes of rambus dynamic random access memory (RDRAM) 78, a portion of which is used for storing image data for objects that will be combined to produce a composite image in accordance with the present invention.

Figure 6:
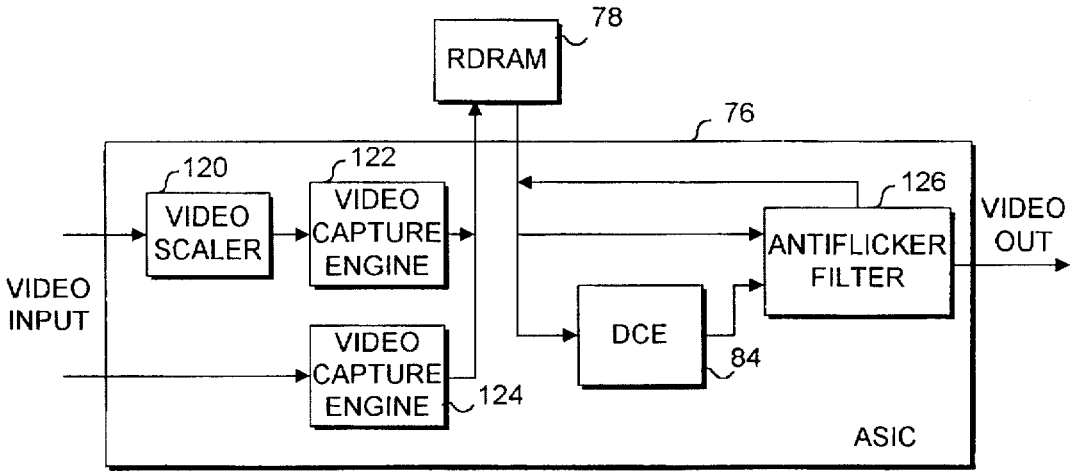
FIG. 6 is a block diagram of the ASIC used in the set top box.

A component of ASIC 76 that will be used for carrying out the present invention is a dynamic composition engine (DCE) 84, as shown in FIG. 6. As shown in this Figure, digital video data are input either to a channel that includes a video scalar 120, or to a channel without a video scalar. Video scalar 120 scales the image represented by the video digital data to a desired size/resolution. The video data scaled by the video scalar are captured by a video capture engine 122 or by a video capture engine 124 if not scaled and are stored in RDRAM 78. RDRAM 78 is coupled to DCE 84, so that the bitmapped data comprising each object to be included in a composite image are available to the DCE. The output from the DCE is applied to an antiflicker filter 126, that is activated on a pixel-by-pixel basis, depending upon a Filter field flag setting in the data structure stored in RDRAM 78 that controls the composition of the composite image (explained below). The output signal from ASIC 76 comprises the digital data for a scan line, produced by composing each pixel on the scan line into a line buffer (not shown).

Since each line (or multiple lines) comprising a frame being displayed are composited on-the-fly, very little memory is required to display the composited image. Although the bitmap data for each of the objects are stored in RDRAM, only two line buffers are required in the memory. A first line buffer is required to store the line currently being scanned onto the display, and a second line buffer is provided to compose the pixels for the next line to be displayed. The present invention thus substantially reduces the total amount of memory required for displaying a composite image compared to the prior art in which at least one frame buffer is required to store an image that will be displayed on the screen.

With reference back to FIG. 3, ASIC 76 is coupled to a video/audio interface 80. This interface is also connected to PCI bus 72 and ISA bus 68, for receiving control signals that determine how the video and audio signals produced by the set top box and received from external signal sources are handled. A network and cable tuner block 82 is connected to the video/audio interface and receives broadcast signals and other video signals from external devices such as a laser video player and/or a VCR. Network and cable tuner block 82 passes an audio signal to video/audio interface 80 and supplies an analog video signal to an analog to digital (ADC) 81. ADC 81 converts the video signal to a corresponding digital signal that is input to ASIC 76. Video/audio interface 80 produces (and receives) conventional video and audio signals, an SVHS signal, and a conventional radio frequency television signal through connectors (not shown) on the rear panel of the set top box. Any digital data in the video signals processed by network and cable tuners block 82 are input to PCI slot 74.

Figure 4:
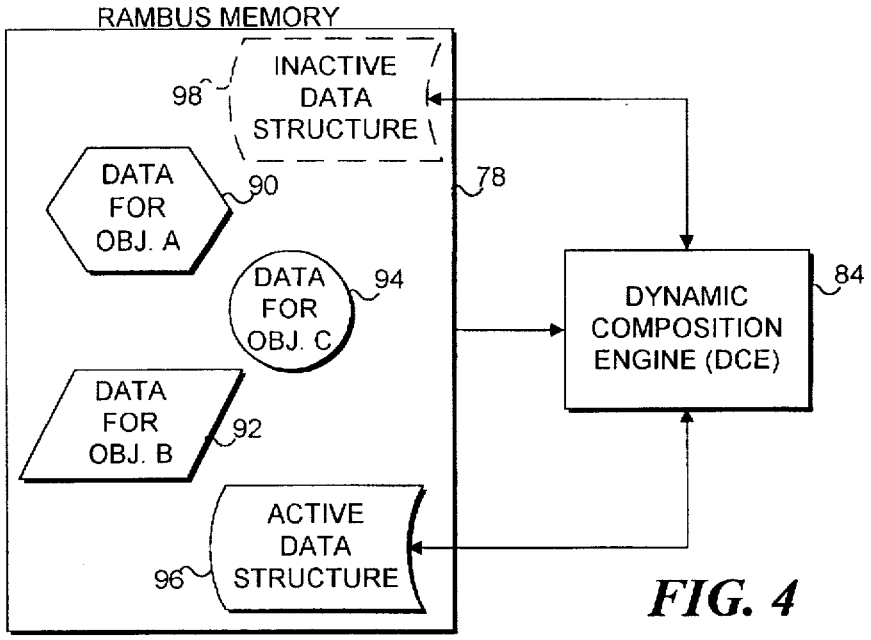
FIG. 4 is block diagram that graphically illustrates how data defining a plurality of objects are stored in a "rambus" memory, along with an active and an inactive data structure, for use by a dynamic composition engine (DCE), which is included in an application specific integrated circuit (ASIC) in the set top box.

Graphic objects that will be mixed with objects in other video signals to produce a composite image are produced by CPU 60, typically in response to a software program that the CPU is executing. In FIG. 4, RDRAM 78 is employed for storing data in digital form that define three graphic objects.

These graphic objects will be combined (possibly, with other video image data) for display on the screen of a television receiver or video monitor. The data defining each object are not actually shown in the Figure. Instead, different shapes representing the three objects are used in the Figure to differentiate the image data for an object A, which is stored starting at a memory address 90, for an object B, which is stored starting at a memory address 92, and for an object C, which is stored starting at a memory address 94. The different shapes are shown at different positions within the illustrated block of memory, to indicate that the data for each object are spread throughout the RDRAM. One of the three objects in this simple example may comprise a single color background for the other two objects.

RDRAM 78 also stores an active data structure 96 that defines how a frame of a composite image currently being displayed is configured using the image data for the three objects. A number of parameters are specified in the data structure to define the composite image. For example, the "z-order" of the objects specifies the stacking order of the objects, i.e., the order in which the objects are ordered in successive layers on the screen. An "alpha" parameter determines the transparency of one object relative to another, thereby specifying to what extent, if any, one object is visible behind another object that overlaps it in the z-order. In addition, the RDRAM stores an inactive data structure 98 that represents the specifications for a frame of a composite image that will next be displayed on the screen.

The data structures that specify the image for the current and next frames are relatively small, using very little memory compared to the amount of memory required for storing the data for a full frame of an image. The small amount of memory required to store the data structure for an image frame provides a substantial advantage, compared to the prior art, since a frame buffer capable of storing an entire frame of image data need not be generated prior to displaying the frame. Instead, each line of the composite image to be displayed is generated on-the-fly, thereby minimizing the requirements for memory. Only a pair of line buffers that are alternately filled and displayed are required in the preferred embodiment of the present invention. It is also contemplated that a plurality of lines can be generated on-the-fly. However, even if this option is adopted, far fewer than all of the lines required for a frame would need to be generated and stored at one time. Therefore, only a relatively small amount of memory is required for the line buffer or multi-line buffer (if a plurality of lines—much less than the total number of lines of a frame—are generated on-the-fly).

Figure 5:
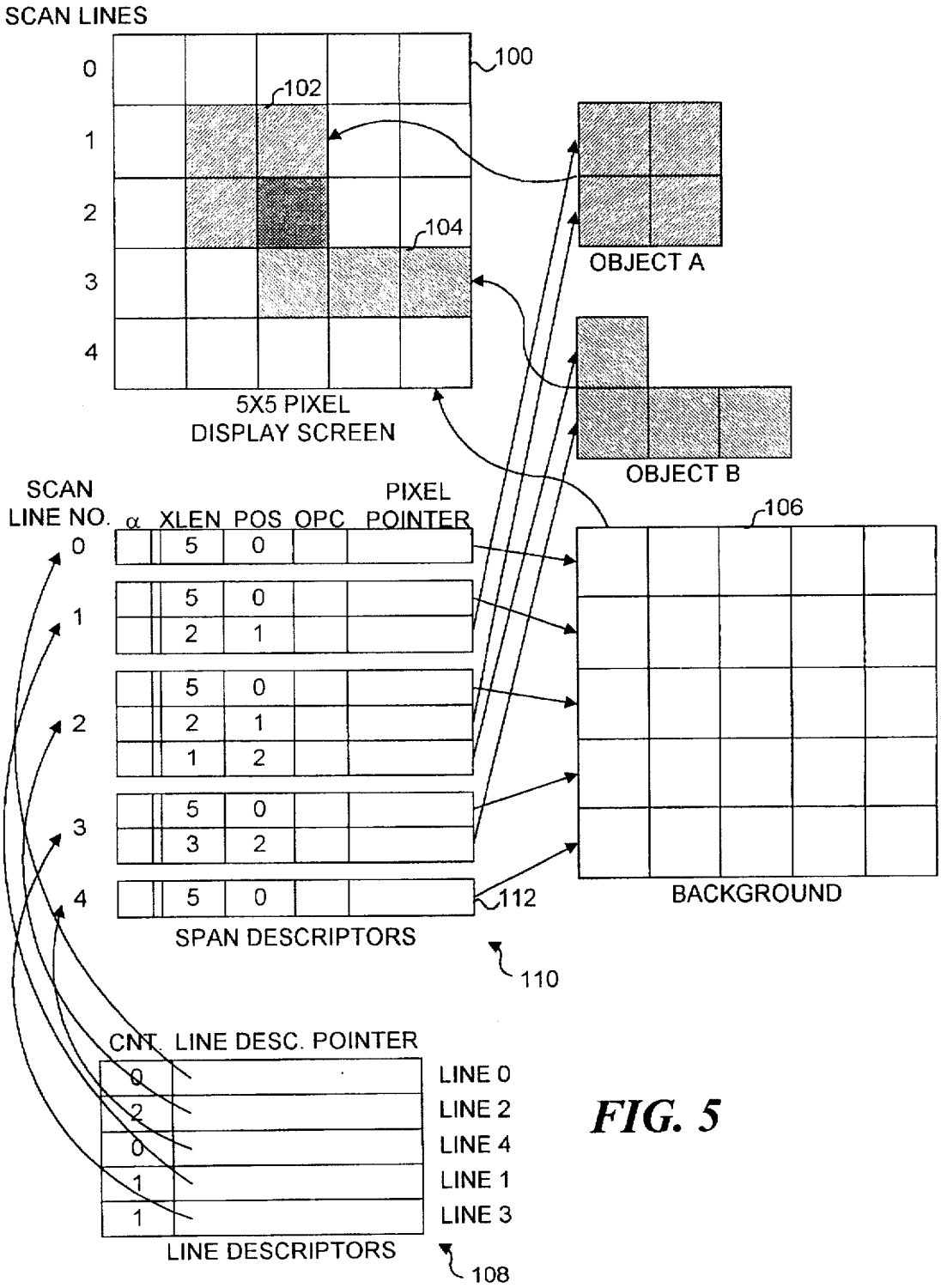
FIG. 5 is a simplistic illustration of a data structure in accord with the present invention, for use in describing two graphic objects to be displayed as a composite image on a screen that is only 5×5 pixels in size.

A simple example will illustrate how the active data structure specifies a composite image comprising a plurality of objects. In this simplistic example, which is shown in FIG. 5, the image frame comprises five scan lines, each of which include five pixels. The composite image includes an object A and an object B, which are respectively represented in the composite image at positions 102 and 104. An upwardly extending pixel on object B overlaps a lower right corner of object A. The two objects are disposed on a background 106, which is of a uniform color and covers the 25 pixels comprising the simple frame in this example. The highest level of the data structure used to specify the composite image is a Screen Descriptor 108. Screen Descriptor 108 comprises an array of pointers to a plurality of Line Descriptors, including one for each of the lines comprising the frame.

As indicated in FIG. 5, the array of pointers need not be in the same order in which the lines appear within the frame. In addition to including a pointer to each Line Descriptor, the lines in the Screen Descriptor each include a count indicating the number of Span Descriptors comprising each Line Descriptor. In this paradigm, a count of "0" indicates that only the background pixels 106 appear in the scan line referenced by the pointer. Similarly, a count of 2 indicates that portions of objects A and B and the background appear on the scan line.

The pointers to the Line Descriptors are represented as arrows in the lower left corner of FIG. 5, directed to Line Descriptors 110. In reality the pointers are addresses in RDRAM 78 at which the Line Descriptors are stored. Each Line Descriptor includes the number of Span Descriptors indicated by the count in the Screen Descriptor entries and thus contains sufficient Span Descriptors to fully describe the line.

For the example shown in FIG. 5, a Span Descriptor 112 for line 4 includes an alpha parameter, a length parameter, which indicates the length of the span in pixels, the starting position of the span, which for line 4 is zero, and an operational code (opcode) that determines the span composition. Also included is a pixel pointer that defines the byte aligned physical address of the source pixels for objects that will be used in the composite image. The source pixels within a single span must be physically contiguous in memory and naturally aligned in the preferred embodiment. In general, however, the source address for portions of an object on different lines can be scattered throughout RDRAM. The Line Descriptor for line 1, the second line in the frame of the example, includes two Span Descriptors, the first (for background 106) having a length of 5 and starting at position 0; the second Span Descriptor (for object A) has a length 2, and starts at a position 1, the second pixel in the scan line. Similarly, Span Descriptors are provided for each Line Descriptor in connection with the other lines of the frame. Scan line number 2, the third line in the image, includes three Span Descriptors. One Span Descriptor is for the background, one is for object A (lower right corner pixel), and one is for object B (upper left pixel). The alpha parameter of the Span Descriptor for object B in this Line Descriptor determines the opacity of the pixel, i.e., how the span will be mixed with the pixel for object A, which is behind the pixel for object B in the z-order. For a line that contains a per-pixel alpha, the alpha characteristic is ignored. In the preferred embodiment, an alpha value of zero indicates that the span is entirely transparent, while an alpha value of 255 indicates that the span is entirely opaque. Thus, if the alpha parameter is set to 255, the pixel of object B completely obscures the overlapped pixel of object A. As the alpha parameter for the span on this line that is occupied by object B is decreased, the overlapped pixel of object A becomes more visible behind the pixel of object B in the composite image.

The opcode parameter includes six field values that are defined by various bits of an 8-bit field. In the preferred embodiment, the fields defined by the eight bits of the opcode are described in Table 1 below.

TABLE 1

| BIT | FIELD | DESCRIPTION |
|---|---|---|
| 7 | Valid | This bit indicates whether the span is valid. |
| 6 | Interrupt | This bit indicates whether an interrupt is to be generated when the span is processed; the source address field of the Span Descriptor is captured in the Interrupt register when an interrupt is generated. |
| 5 | Upsample | This bit indicates whether each pixel in the source bitmap is to be duplicated to produce the span being composited; the Xlength field of the opcode indicates the number of source pixels being read - not the number of pixels being composited. |
| 4 | XColor | This bit indicates whether the pixels in the source should be compared with the appropriate transparent color register to determine if the pixel alpha parameter should be set to zero. |
| 3 | Filter | This bit indicates whether the span should be filtered before output, by the hardware antiflicker filter. |
| 2:0 | Format | This field indicates the bitmap format, including the six in Table 2. |

In Table 1, the Valid flag indicates that a span is valid and is cleared if the span is to be ignored. The Interrupt bit is a flag indicating that an interrupt should be generated when the span is processed. If this bit is set and the Valid flag is set, then an interrupt is generated and the source address field of the Span Descriptor is captured in the interrupt register. The Upsample flag indicates that the source pixels are to be duplicated to produce the span. When this bit is set, the source pixels are thus upsampled, creating a span that is two times the length set for the Span Descriptor to be generated. The X color flag indicates that the source pixel values for the span are to be compared against the appropriate transparent color register to determine if the pixel alpha should be set to 0, i.e., indicating a transparent condition. If the X color flag is set, then the transparent color check takes place. There are three transparent color registers, including one for palletized pixels, one for RGB pixels, and one for YCrCb pixels. The Filter flag indicates that the resulting pixel in the span is to be filtered. It is possible to have overlapping spans with different values for the filter flag; however, the front-most non-transparent span determines whether a given pixel will be filtered. Bits 0 through 2 define the format for the bitmap of the image.

Table 2 lists the six bitmap formats that are supported in the preferred embodiment.

TABLE 2

| CODE | FORMAT | DESCRIPTION |
|---|---|---|
| 000 | 8-bit Pallet | Source pixels are fetched as bytes and used to index a pallet with 256 entries to specific a 24-bit YCrCb pixel value. |
| 001 | Fill | The source address field of the Span Descriptor is interpreted as an RGB pixel. |
| 010 | 24-bit RGB | Source pixels are fetched four bytes at a time; the 3 least significant bytes are interpreted as true-color RGB; and the most significant byte is ignored. |
| 011 | 24-bit RGB+a | Source pixels are fetched as four bytes; the low three bytes are interpreted as 24-bit RGB; and the highest order byte is the alpha parameter for the pixel. |
| 100 | Reserved | |
| 101 | 8-bit Pallet+a | Source pixels are fetched as two bytes; the odd byte is the alpha parameter for the pixel. |
| 110 | 16-bit RGB | Source pixels are fetched two bytes at a time and interpreted as 5:6:5 RGB. |
| 111 | 16-bit YCrCb | Source pixels are fetched in pairs, four bytes at a time; The Cr and Cb samples are sub-sampled 2:1 as per the CCIR 601 Standard (4:2:2). |

Contrary to the simplistic example presented in FIG. 5, a Screen Descriptor for the preferred embodiment comprises a physically contiguous 2 Kbyte aligned array in RDRAM 78 of either 240 entries when the DCE is operating in a field mode, or 480 entries when the DCE is operating in a frame mode. In the frame mode, the first 240 entries correspond to an even numbered NTSC field (even numbered scan lines), and the remaining 240 entries correspond to an odd NTSC field (odd numbered scan lines).

Each Screen Descriptor entry is four bytes in size. The three least significant bytes contain the physical address of a Line Descriptor, and the low three bits of the address are ignored, since in the preferred embodiment, the Line Descriptor must be octal-byte aligned. There can be up to 256 spans for a given line, i.e., up to one Span Descriptor per pixel in the line. In the preferred embodiment, each Span Descriptor is 8 bytes in size and is octal-byte aligned.

The Span Descriptors within a Line Descriptor are sorted in z-order from back to front, and the x-order (horizontal position within the line) of the Span Descriptors for each line is generally arbitrary. Every Line Descriptor contains at least one Span Descriptor, even if defining a pixel that is transparent.

The DCE preferably contains two line composition buffers. While one line, which was previously composed in a first line composition buffer, is being displayed on the display screen, the DCE composes the next line for display in a second line composition buffer. As each line is processed, the DCE reads the next Screen Descriptor entry and fetches the corresponding Line Descriptor. The Span Descriptors from the current Line Descriptor are decoded and the source pixels for the object defined by the span are fetched and composed into the current line composition buffer based upon the Span Descriptor opcode. When the next horizontal retrace occurs, the line composition buffers are swapped so that the DCE can begin composing the next line while the current line is being displayed. When the line composition buffers are swapped, the pixel values are not modified. If a horizontal retrace occurs before all of the Span Descriptors in the current Line Descriptor have been processed, line composition is terminated and the line buffers are swapped. The DCE discards the remaining Span Descriptors in the current Line Descriptor, since there is inadequate time for processing them. Because the pixel values were not initialized when the line buffers were swapped, any unwritten pixels will have the value from the previous line.

At the end of each frame or field, depending upon the mode in which the DCE is operating, the DCE begins fetching the Screen Descriptor from the Screen Descriptor base address indicated in the DCE Control register. The Screen Descriptor base address can be changed at any time but the change does not take effect until the end of the next field or frame.

Two events can cause an interrupt of the operation being performed by the DCE. First, the processing of a Span Descriptor in which the Interrupt bit is set can initiate an interrupt. Secondly, the expiration of the time to display a line before the pixel composition of the next line has been completed can initiate an interrupt. These events are always logged into a DCE Interrupt Register, regardless of whether the interrupts are enabled.

If a Span Descriptor is processed in which both the Valid bit and the Interrupt bit are set, the Span Interrupt Active bit in the Interrupt Register is set and the Interrupt Status field is written with the source address of the Span Descriptor generating the interrupt. Once a span interrupt is active, any other Span Descriptor interrupt bits will be ignored until the interrupt is cleared. Thus, the DCE only responds to the first span interrupt, even though a second interrupt occurs before the first span interrupt is cleared. Should an interrupt occur because the time to display a line has elapsed before the next line to be displayed is fully composed, the Error Interrupt Active bit in the Interrupt Register is set. Both types of interrupt flags are cleared when the Interrupt Register is read. A Span Interrupt Enable bit in the DCE Control register determines whether the Span Interrupt Active condition will generate an interrupt. An Error Interrupt Enable bit in the DCE Control register similarly determines if the Error Interrupt Active condition will result in the generation of an interrupt.

The software controlling processor 60 produces two Screen Descriptors with 480 entries each, but only one Screen Descriptor is active at a time in controlling the composition of the frame currently being written to the screen. The last Line Descriptor of each Screen Descriptor contains a single Span Descriptor with the Interrupt bit set and with the XLength field for the span set to zero so that no pixels are actually written to the display screen. The source address (SrcAdr) fields of these final Span Descriptors can be used to store the address of the other Screen Descriptor. An interrupt is thus generated at the end of each frame. The contents of the Interrupt Register are a pointer to the other Screen Descriptor (address). Using this technique, the Screen Descriptor base address can remain unchanged, and the DCE will generate a display screen based on the currently active Screen Descriptor. When the displayed screen must be changed, e.g., because a bitmap object has moved or changed, the graphic system software running on CPU 60 generates a new Screen Descriptor. For those lines that have not changed, the Line Descriptor entries for the new Screen Descriptor are copied from the current Screen Descriptor. Alternatively, pointers to the Line Descriptor entries for the current Screen that have not changed are provided to determine the corresponding entries for the new Screen. However, for those lines that have changed, new Line Descriptors are generated. When the new Screen Descriptor is complete, the Screen Descriptor base address is updated to the address of the new Screen Descriptor. After the next DCE Interrupt that occurs at the last Line Descriptor for the current frame, the previously active Screen Descriptor becomes inactive, i.e., free to be modified to reflect the next set of changes for display in the next frame. Composition of a new Screen Descriptor accordingly occurs while the previously composited Screen Descriptor is being used to write a new frame on the display screen.

Another feature of the present invention is its ability to mix pixels that are defined by different palettes, in the same scan line of the composite image. For displaying digital graphic objects, a universal palette can be employed that includes 256 colors specifically selected to optimally display virtually any image.

Ideally, all graphic objects would use this universal palette. However, graphic objects may be produced by applications that do not employ the universal palette. Instead, a variable palette that includes other colors may be employed for a graphic object. When composing the pixels in the line buffer, DCE 84 is able to mix pixels using any combination of variable palettes or the universal palette on the same scan line, so that each pixel is displayed with its own palette of colors.

The preferred embodiment of this invention is presently implemented in hardware using the DCE. However, it is also contemplated that the invention can readily be implemented in software that runs on CPU 60. The steps employed by the software would be generally consistent with those implemented by DCE 84 and other components of ASIC 76. Given the above disclosure, one of ordinary skill should be able to easily write a software program in accord with the present invention, to generate a composite image by filling a line buffer on-the-fly with pixels, as determined by the Screen Descriptor data structure disclosed above.

Although the present invention has been described in connection with the preferred form of practicing it, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. A method for displaying objects on a screen as an image that comprises a plurality of scan lines, comprising the steps of:

(a) storing bitmap data in a memory for each object to be displayed on the screen;

(b) creating a data structure based on the bitmap data for each object, said data structure describing each object to be displayed on the screen and including a Screen Descriptor referencing a plurality of Line Descriptors that define the composition of each scan line of the screen, providing a composite of any objects that overlap on the scan line;

(c) storing the data structure in the memory;

(d) processing the data structure to produce video data for each scan line to be displayed on the screen; and (e) generating an image on the screen using the video data for the scan lines of the screen, said image displaying the composite of any overlapping objects on the scan lines.

2. The method of claim 1, wherein the plurality of Line Descriptors each include at least one Span Descriptor, each Span Descriptor comprising information required to compose a span of the scan line, each span comprising a segment of the scan line in which one of a background and at least a portion of an object is disposed.

3. The method of claim 2, wherein the information in the Span Descriptor includes a length and a position of the span in the scan line, and an opcode that describes a format for elements of the screen comprising the image to be displayed.

4. The method of claim 2, wherein the information in the Span Descriptor includes a value that determines how the span will be mixed with an element that it overlaps in the scan line when the scan line is displayed on the screen.

5. The method of claim 1, wherein the data structure is processed one scan line at a time to generate the image.

6. The method of claim 1, wherein the data structure is processed for a plurality of scan lines at a time to generate the image.

7. The method of claim 1, wherein the Screen Descriptor includes a plurality of entries corresponding in number to the number of scan lines on the screen, an entry for a scan line comprising a count indicating the number of spans on said scan line and a pointer to the Line Descriptor for said scan line.

8. The method of claim 1, wherein the step of processing the data structure to produce video data for each scan line comprises the step of alternately loading one of two scan line composition buffers with the video data while video data in the other scan line composition buffer are displayed on the screen and then loading the other scan line composition buffer with video data while the video data in the one scan line composition buffer are displayed on the screen.

9. The method of claim 1, further comprising the step of creating an inactive Screen Descriptor that becomes active when a new frame is to be displayed on the screen, the Screen Descriptor that was previously used to produce video data becoming inactive while being updated to display a subsequent new frame on the screen.

10. The method of claim 9, wherein Screen Descriptor entries from an active Screen Descriptor are employed in the inactive Screen Descriptor for any scan lines that are unchanged in the subsequent new frame to be displayed, and new entries are created for scan lines that are changed in the subsequent new frame.

11. The method of claim 10, wherein pointers to the Screen Descriptor entries from the active Screen Descriptor are used to reference said Screen Descriptor entries for use in the subsequent new frame for any scan lines that are unchanged.

12. The method of claim 10, wherein a last Scan Descriptor in the active Screen Descriptor initiates an activation of the inactive Screen Descriptor and inactivation of the active Screen Descriptor.

13. The method of claim 1, wherein the Screen Descriptor includes pointers to the Line Descriptors in the memory.

14. The method of claim 1, wherein one Span Descriptor in a Line Descriptor specifies a fixed palette and a different Span Descriptor in said Line Descriptor specifies a variable palette to determine colors applied to each object displayed on the screen.

15. The method of claim 14, wherein the fixed palette is a universal palette that includes colors for optimally displaying objects on the screen, and the variable palette is a palette associated with an object, which may be different for different objects.

16. A system adapted for controlling the display of objects on a screen as an image comprising a plurality of scan lines, comprising:

(a) a memory for storing bitmap data for each of the objects and machine instructions controlling the operation of the system;

(b) a processor, coupled to the memory, for executing the machine instructions so as to implement a plurality of functions used for controlling the display of the objects, said plurality of functions including producing control signals for a dynamic composition engine, said dynamic composition engine producing video signals that are adapted to drive the screen to display the objects in response to the control signals, said dynamic composition engine including:

(i) means for creating a data structure based upon the bitmap data for each of the objects to be displayed, said data structure being stored in the memory, describing each object to be displayed on the screen, and including a Screen Descriptor referencing a plurality of Line Descriptors that define the composition of each scan line of the screen providing a composite of any objects that overlap on the scan line; and (ii) means for processing the data structure to produce video data for each scan line to be displayed on the screen; and (c) said system further including means for generating an image on the screen using the video data for the scan lines of the screen, said image displaying the composite of any overlapping objects on the scan lines.

17. The system of claim 16, wherein the processor, the memory, and the dynamic composition engine comprise a component to be used with a television, said television including the screen on which the image is displayed.

18. The system of claim 16, wherein the plurality of Line Descriptors each include at least one Span Descriptor, each Span Descriptor comprising information required to compose a span of the scan line, each span comprising a segment of the scan line in which one of a background and at least a portion of an object is disposed.

19. The system of claim 16, wherein the information in the Span Descriptor includes a length and a position of the span in the scan line, and an opcode that describes a format for elements of the screen comprising the image.

20. The system of claim 16, wherein the information in the Span Descriptor includes a value that determines how the span will be mixed with an element that it overlaps in the scan line when the scan line is displayed on the screen.

21. The system of claim 16, wherein the Screen Descriptor includes a plurality of entries corresponding in number to the number of scan lines on the screen, an entry for a scan line comprising a count indicating the number of spans on said scan line and a pointer to the Line Descriptor for said scan line.

22. The system of claim 16, further comprising two scan line composition buffers that are alternately loaded with video data for successive scan lines of the image, one of the scan line composition buffers being loaded with video data while video data in the other scan line composition buffer are displayed on the screen to compose the image, the other scan line composition buffer being then loaded with video data while the video data in said one scan line composition buffer are displayed on the screen to further compose the image.

23. The system of claim 16, further comprising means for creating an inactive Screen Descriptor that becomes active when a new frame is to be displayed on the screen, the Screen Descriptor that was previously used to produce video data then becoming inactive while being updated to display a subsequent new frame on the screen.

24. The system of claim 23, wherein Screen Descriptor entries from an active Screen Descriptor are employed in the inactive Screen Descriptor for any scan lines that are unchanged in the subsequent new frame to be displayed, and new entries are created for scan lines that are changed in the subsequent new frame.

25. The system of claim 24, wherein pointers to the Screen Descriptor entries from the active Screen Descriptor are provided to access said Screen Descriptor entries used in the subsequent new frame for any scan lines that are unchanged.

26. The system of claim 16, wherein the means for processing process the data structure one scan line at a time to generate the image.

27. The system of claim 16, wherein the means for processing process a plurality of scan lines at a time using the data structure to generate the image.

28. The system of claim 16, wherein the Screen Descriptor includes pointers to the Line Descriptors in the memory.

29. The system of claim 16, wherein one Span Descriptor in a Line Descriptor specifies a fixed palette and a different Span Descriptor in said Line Descriptor specifies a variable palette to determine colors applied to each object displayed on the screen.

30. The system of claim 29, wherein the fixed palette is a universal palette that includes colors for optimally displaying objects on the screen, and the variable palette is a palette associated with an object, which may be different for different objects.

* * * * *